US009227713B2

(12) United States Patent
Koga

(10) Patent No.: US 9,227,713 B2
(45) Date of Patent: Jan. 5, 2016

(54) OUTBOARD MOTOR

(71) Applicant: YAMAHA HATSUDOKI KABUSHIKI KAISHA, Iwata-shi, Shizuoka (JP)

(72) Inventor: Hiroki Koga, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 185 days.

(21) Appl. No.: 13/919,060

(22) Filed: Jun. 17, 2013

(65) Prior Publication Data

US 2014/0106633 A1 Apr. 17, 2014

(30) Foreign Application Priority Data

Oct. 17, 2012 (JP) ..... 2012-230015

(51) Int. Cl.
*B63H 20/24* (2006.01)

(52) U.S. Cl.
CPC ..... *B63H 20/245* (2013.01)

(58) Field of Classification Search
CPC ..... B63H 20/245; F01N 13/12; F01N 13/004; F01N 2590/021
USPC ..... 440/89 R
See application file for complete search history.

(56) References Cited

U.S. PATENT DOCUMENTS 5,041,036 A * 8/1991 Clark et al. ..... 440/89 R
7,513,811 B2 4/2009 Kameoka et al.
2002/0197921 A1* 12/2002 Nakata et al. ..... 440/89

FOREIGN PATENT DOCUMENTS

JP 11-115895 A 4/1999

* cited by examiner

*Primary Examiner* — S. Joseph Morano
*Assistant Examiner* — Anthony Wiest
(74) *Attorney, Agent, or Firm* — Keating and Bennett, LLP

(57) ABSTRACT

An outboard motor includes an engine, an exhaust passage member, and an idle exhaust passage member. The exhaust passage member defines a main exhaust passage through which exhaust gases of the engine are guided to a main exhaust port disposed in the water, and also defines a portion of an idle exhaust passage through which exhaust gases in the main exhaust passage are guided to an idle exhaust port opened to the atmosphere. The idle exhaust passage member includes an upstream end connected to the exhaust passage member and a downstream end that defines the idle exhaust port and is disposed at a higher position than the upstream end. The idle exhaust passage member is made of a flexible material, and is integrally formed from the upstream end to the downstream end.

9 Claims, 7 Drawing Sheets

OUTBOARD MOTOR

BACKGROUND OF THE INVENTION

1. Field of the Invention

The present invention relates to an outboard motor.

2. Description of the Related Art

Japanese Unexamined Patent Application Publication No. H11-115895 and U.S. Pat. No. 7,513,811 disclose outboard motors, each of which includes a main exhaust passage through which exhaust gases from an engine are discharged into water and an idle exhaust passage through which exhaust gases are discharged into the atmosphere during idling of the engine. The idle exhaust passage diverges from the main exhaust passage in a casing that supports the engine, and an idle exhaust port corresponding to an outlet of the idle exhaust passage is opened to the atmosphere.

SUMMARY OF THE INVENTION

The inventor of preferred embodiments of the present invention described and claimed in the present application conducted an extensive study and research regarding an outboard motor, such as those described above, and in doing so, discovered and first recognized new unique challenges and previously unrecognized possibilities for improvements as described in greater detail below.

More specifically, the idle exhaust port corresponding to the outlet of the idle exhaust passage is opened to the atmosphere, and therefore, if the height of the idle exhaust port is low, there is a possibility that a spray of water will enter the idle exhaust passage through the idle exhaust port or that the idle exhaust port itself will be submerged in the water.

The idle exhaust port of Japanese Unexamined Patent Application Publication No. H11-115895 is disposed at a lower position than an engine cover with which the engine is covered. On the other hand, the idle exhaust port of U.S. Pat. No. 7,513,811 is disposed at the same height as an engine cover with which the engine is covered. Therefore, in the outboard motor of U.S. Pat. No. 7,513,811, it is difficult for water to enter the idle exhaust passage through the idle exhaust port.

However, in the outboard motor of U.S. Pat. No. 7,513,811, the casing and the idle exhaust port are connected to each other by a lower communicating tube that extends upwardly from the casing that supports the engine, an expansion chamber case connected to the lower communicating tube, and an upper communicating tube that extends upwardly from the expansion chamber case in order to locate the idle exhaust port at a higher position. Therefore, the number of components of the outboard motor increases.

Additionally, in the outboard motor of U.S. Pat. No. 7,513,811, the lower communicating tube is fixed to the casing, and the upper communicating tube is fixed to the engine cover. The casing and the engine cover vibrate or move relative to each other. Therefore, if the lower and upper communicating tubes cannot follow or move with the casing and the engine cover, there is a possibility that the position of the lower communicating tube and that of the upper communicating tube will deviate.

In order to overcome the previously unrecognized and unsolved challenges described above, a preferred embodiment of the present invention provides an outboard motor including an engine, an exhaust passage member, and an idle exhaust passage member. The exhaust passage member is disposed below the engine. The exhaust passage member defines a main exhaust passage arranged to guide exhaust gases of the engine to a main exhaust port disposed in water, and also defines a portion of an idle exhaust passage diverging from the main exhaust passage and arranged to guide exhaust gases in the main exhaust passage to an idle exhaust port opened to the atmosphere. The idle exhaust passage member includes an upstream end connected to the exhaust passage member and a downstream end that is disposed at a higher position than the upstream end and that defines the idle exhaust port. The idle exhaust passage member is made of a flexible material, and is integrally formed from the upstream end to the downstream end. The idle exhaust passage member defines a downstream portion of the idle exhaust passage and connects the idle exhaust passage portion of the exhaust passage member to the idle exhaust port.

According to this arrangement of the present preferred embodiment of the present invention, the main exhaust passage through which exhaust gases of the engine are guided to the main exhaust port disposed in water is defined by the exhaust passage member disposed below the engine. A portion of the idle exhaust passage through which exhaust gases in the main exhaust passage are guided to the idle exhaust port opened to the atmosphere is defined by the exhaust passage member. The idle exhaust passage diverges from the main exhaust passage inside the exhaust passage member. The idle exhaust passage member defines the downstream portion of the idle exhaust passage through which the idle exhaust passage portion of the exhaust passage member and the idle exhaust port are connected together.

The idle exhaust port corresponding to the outlet of the idle exhaust passage is defined by the downstream end of the idle exhaust passage member. The downstream end of the idle exhaust passage member is disposed at a higher position than the upstream end of the idle exhaust passage member. Therefore, the idle exhaust port can be disposed at a high position on the outboard motor. Therefore, it is difficult for a spray of water to enter the idle exhaust passage from the idle exhaust port, and it is difficult for the idle exhaust port to be submerged in water. This makes it possible to reduce the amount of water entering the idle exhaust passage from the idle exhaust port.

Additionally, the idle exhaust passage member is preferably a single, integral member from its upstream end to its downstream end. Therefore, it is possible to reduce the number of components of the outboard motor. This makes it possible to reduce the production time and production costs required to produce the outboard motor. Additionally, the idle exhaust passage member is made of a flexible material, and therefore it is possible to move with the vibrations of the exhaust passage member. This makes it possible to reduce the amount of positional deviation of the idle exhaust passage member and to prevent the idle exhaust passage member from detaching from the exhaust passage member.

In a preferred embodiment of the present invention, the outboard motor may additionally include an engine cover with which the engine is covered. If so, a downstream end portion of the idle exhaust passage member may be supported by the engine cover.

According to this arrangement of the present preferred embodiment of the present invention, the downstream end portion of the idle exhaust passage member is supported by the engine cover with which the engine is covered. Therefore, the idle exhaust passage member is supported by the exhaust passage member and the engine cover. As mentioned above, the idle exhaust passage member is made of a flexible material. Therefore, even if the exhaust passage member and the engine cover vibrate or even if the exhaust passage member and the engine cover move relative to each other, the idle exhaust passage member can follow these movements. This makes it possible to reduce the amount of positional deviation of the idle exhaust passage member and to prevent the idle exhaust passage member from detaching from the exhaust passage member and from the engine cover.

In a preferred embodiment of the present invention, the downstream end of the idle exhaust passage member is disposed at a more rearward position than a lower end portion of the engine cover such that the idle exhaust port is located at a more rearward position than an outer surface of the outboard motor below the idle exhaust port.

According to this arrangement of the present preferred embodiment of the present invention, the downstream end of the idle exhaust passage member that defines the idle exhaust port is disposed at a more rearward position than the lower end portion of the engine cover. The idle exhaust port is opened to the atmosphere and is easily exposed to a spray of water. Therefore, there is a possibility that water that has adhered to the idle exhaust passage member will fall from the idle exhaust port. Additionally, there is another possibility that water in the idle exhaust passage member will fall from the idle exhaust port. The idle exhaust port is disposed at a more rearward position than the outer surface of the outboard motor below the idle exhaust port. Therefore, it is difficult for water that has fallen from the idle exhaust port to adhere to the outer surface of the outboard motor. This makes it possible to reduce the contamination of the outboard motor.

In a preferred embodiment of the present invention, the downstream end portion of the idle exhaust passage member is disposed below the engine cover and along a lower surface of the engine cover.

According to this arrangement of the present preferred embodiment of the present invention, the downstream end portion of the idle exhaust passage member is disposed below the engine cover and along the lower surface of the engine cover. Therefore, the idle exhaust port is disposed at a high position on the outboard motor. Therefore, it is difficult for a spray of water to enter the idle exhaust passage from the idle exhaust port, and it is difficult for the idle exhaust port to be submerged in water. This makes it possible to reduce the amount of water entering the idle exhaust passage from the idle exhaust port.

In a preferred embodiment of the present invention, the outboard motor may additionally include an apron with which the exhaust passage member is covered. If so, the downstream end portion of the idle exhaust passage member may protrude rearwardly from the apron through a space between the engine cover and the apron, and may be supported by the lower end portion of the engine cover such that the downstream end portion of the idle exhaust passage does not contact the apron.

According to this arrangement of the present preferred embodiment of the present invention, the exhaust passage member is covered with the apron. The downstream end portion of the idle exhaust passage member extends through a space between the engine cover and the apron, and protrudes rearwardly from the apron. Therefore, at least one portion of the downstream end portion of the idle exhaust passage member is disposed at a more rearward position than the outer surface of the apron. Therefore, it is difficult for water that has fallen from the idle exhaust port to adhere to the outer surface of the apron. Additionally, the downstream end portion of the idle exhaust passage member is supported by the engine cover such that the downstream end portion of the idle exhaust passage does not contact the apron, and therefore vibrations of the apron are not transmitted to the downstream end portion of the idle exhaust passage member. Therefore, the positional deviation of the downstream end portion of the idle exhaust passage member can be made even smaller.

In a preferred embodiment of the present invention, the idle exhaust passage member may additionally include a liquid guide disposed below the idle exhaust port. The liquid guide may be disposed at a more rearward position than the outer surface of the apron. Additionally, the liquid guide may taper toward a lower end of the liquid guide.

According to this arrangement of the present preferred embodiment of the present invention, the liquid guide disposed below the idle exhaust port is provided in the idle exhaust passage member. Water adhering to the outer surface of the downstream end portion of the idle exhaust passage member or water in the idle exhaust passage member that has reached the vicinity of the idle exhaust port gathers at the liquid guide disposed below the idle exhaust port. Thereafter, the water that has moved to the liquid guide flows downwardly along the outer surface of the liquid guide, and gathers at the lower end of the liquid guide. The liquid guide is tapered toward the lower end of the liquid guide. Therefore, the water that has gathered at the lower end of the liquid guide forms liquid droplets, and these droplets fall from the lower end of the liquid guide. The liquid guide is disposed at a more rearward position than the outer surface of the apron. Therefore, it is difficult for the liquid droplets that have fallen from the liquid guide to adhere to the outer surface of the apron. Therefore, the contamination of the apron can be reduced.

In a preferred embodiment of the present invention, the outboard motor may additionally include a downstream-side mounting structure that includes a mounting hole that extends upwardly from a lower surface of the engine cover and a mounting projection that extends upwardly from the downstream end portion of the idle exhaust passage member, in which the downstream end portion of the idle exhaust passage member is attached to the engine cover by inserting the mounting projection into the mounting hole.

According to this arrangement of the present preferred embodiment of the present invention, the mounting projection extending upwardly from the downstream end portion of the idle exhaust passage member is inserted into the mounting hole extending upwardly from the lower surface of the engine cover. As a result, the downstream end portion of the idle exhaust passage member is attached to the engine cover. Therefore, the downstream end portion of the idle exhaust passage member can be attached to the engine cover by performing an easy operation to insert the mounting projection into the mounting hole, and therefore it is possible to make the production time required to produce the outboard motor even shorter. This makes it possible to reduce the production costs of the outboard motor.

In a preferred embodiment of the present invention, the outboard motor may additionally include an upstream-side mounting structure including a cylindrical projection that is provided with the exhaust passage member and that defines a portion of the idle exhaust passage by an inner peripheral surface of the cylindrical projection, in which the upstream end portion of the idle exhaust passage member is attached to the exhaust passage member by fitting the upstream end portion of the idle exhaust passage member to the cylindrical projection.

According to this arrangement of the present preferred embodiment of the present invention, the cylindrical projection including the inner peripheral surface that defines a portion of the idle exhaust passage is disposed at the exhaust passage member. The upstream end portion of the idle exhaust passage member is attached to the exhaust passage member by fitting the upstream end portion of the idle exhaust passage member to the cylindrical projection. The upstream end portion of the idle exhaust passage member may be fitted to the outer periphery of the cylindrical projection, or may be fitted to the inner periphery of the cylindrical projection. Therefore, the upstream end portion of the idle exhaust passage member can be attached to the exhaust passage member by performing an easy operation to fit the upstream end portion of the idle exhaust passage member to the cylindrical projection, and therefore it is possible to make the production time required to produce the outboard motor even shorter. This makes it possible to reduce the production costs of the outboard motor.

In a preferred embodiment of the present invention, the idle exhaust passage member may include an inner peripheral surface that defines the downstream portion of the idle exhaust passage. If so, the idle exhaust passage member may define a drainage port that extends downwardly from a lower end portion of the inner peripheral surface of the idle exhaust passage member and through which the idle exhaust passage is communicated with an outside of the idle exhaust passage member.

According to this arrangement of the present preferred embodiment of the present invention, the downstream portion of the idle exhaust passage is defined by the inner peripheral surface of the idle exhaust passage member. The idle exhaust passage member defines the drainage port opened at the inner peripheral surface of the idle exhaust passage member. The drainage port extends downwardly from the lower end portion of the inner peripheral surface of the idle exhaust passage member, and the idle exhaust passage is connected to the outside of the idle exhaust passage member through the drainage port. Therefore, water in the idle exhaust passage member is discharged outwardly from the idle exhaust passage member through the drainage port. This makes it possible to reduce the volume of water in the idle exhaust passage member and to prevent the contamination of the inside of the idle exhaust passage member.

In a preferred embodiment of the present invention, the idle exhaust passage member may be a single cylindrical member made of rubber or resin.

According to this arrangement of the present preferred embodiment of the present invention, the idle exhaust passage member is made of an elastic material, such as rubber or resin, and therefore the idle exhaust passage member is easily bent. Therefore, the idle exhaust passage member can reliably follow or move with the displacement of the exhaust passage member and that of the engine cover. This makes it possible to reduce the amount of positional deviation of the idle exhaust passage member and to prevent the idle exhaust passage member from detaching from the exhaust passage member and from the engine cover. Additionally, the idle exhaust passage member is a single cylindrical member, and therefore the number of components of the idle exhaust passage member can be minimized. This makes it possible to reduce the number of components of the outboard motor.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
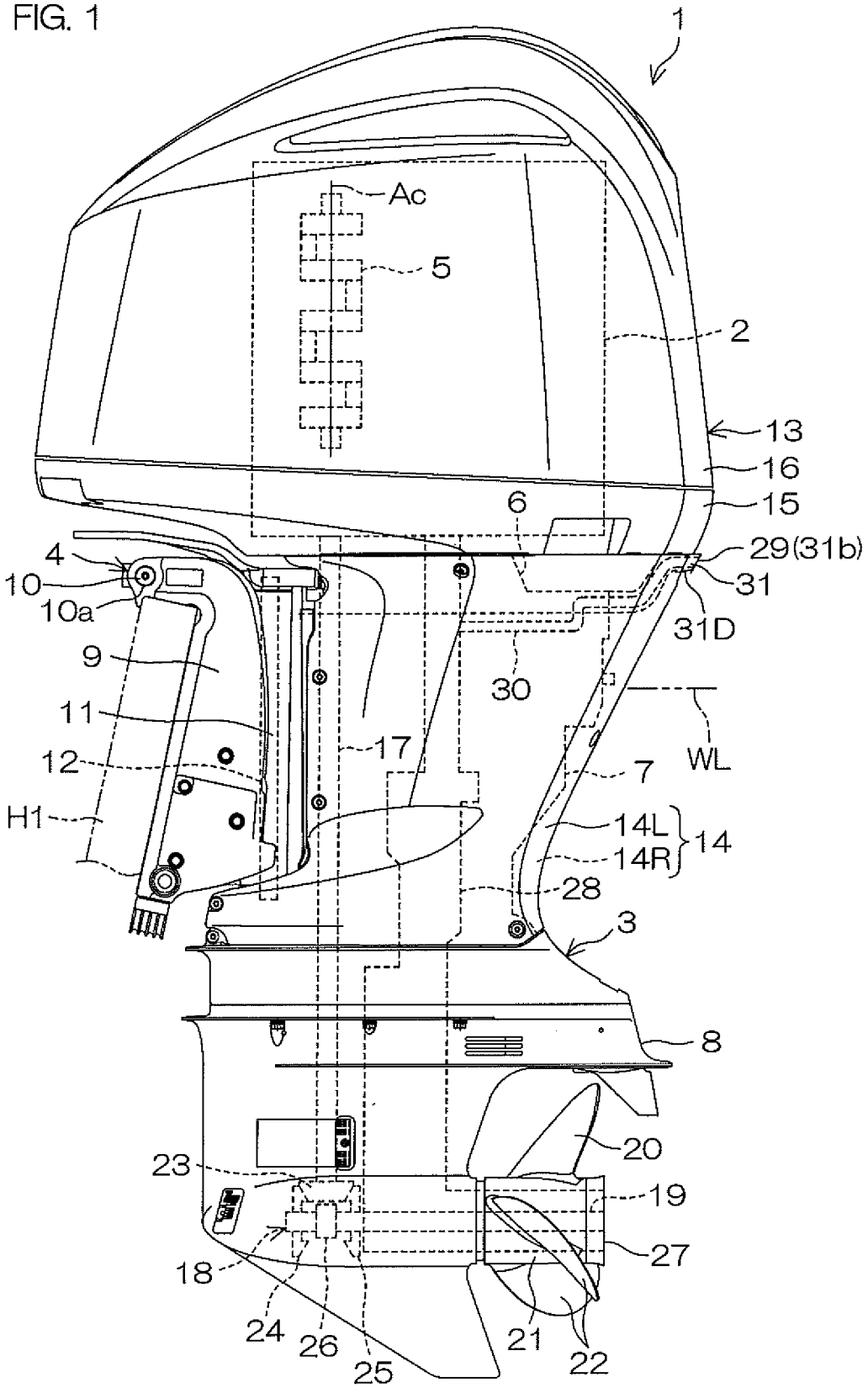
FIG. 1 is a left side view of an outboard motor according to a preferred embodiment of the present invention.
Figure 2:
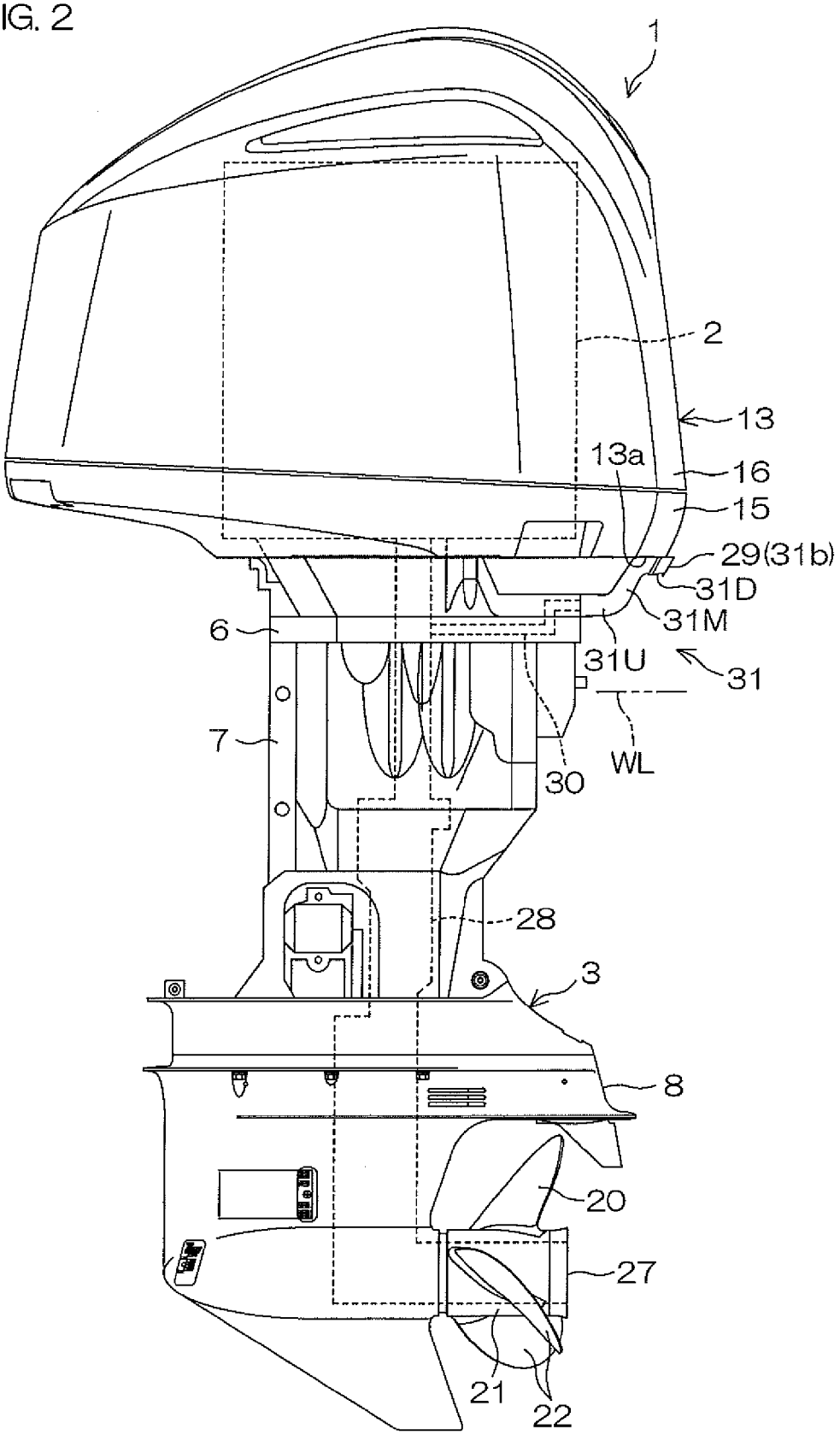
FIG. 2 is a left side view of the outboard motor from which an apron and a suspension device have been detached.
Figure 3:
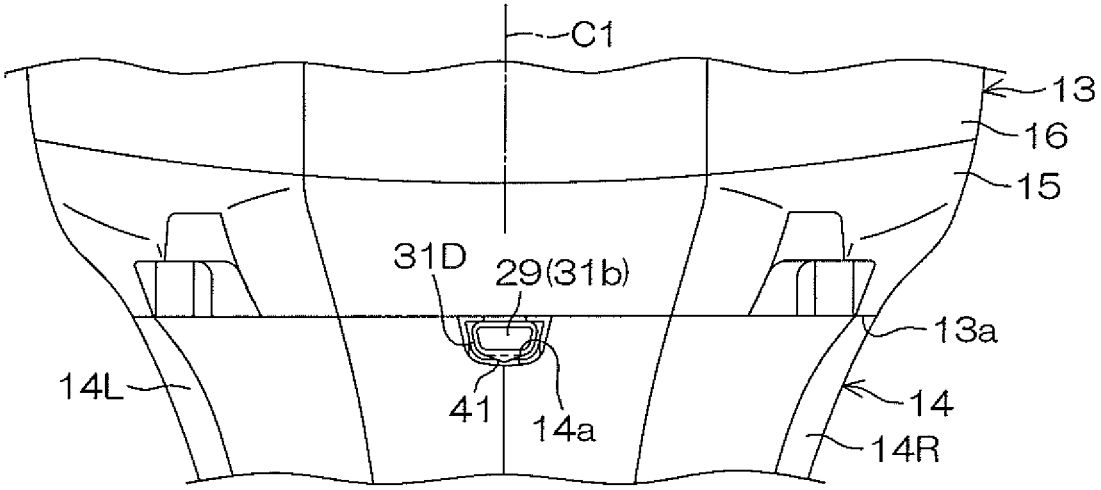
FIG. 3 is a rear view showing an engine cover, an apron, and an exhaust tube.
Figure 4:
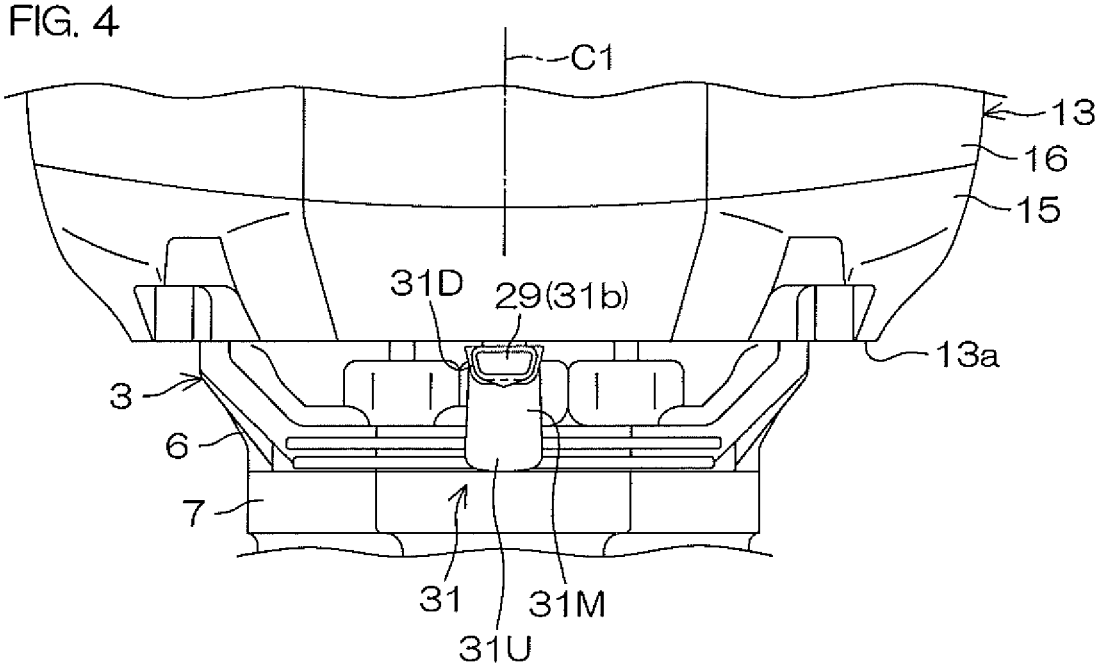
FIG. 4 is a rear view showing a casing, the engine cover, and the exhaust tube.

FIG. 1 is a left side view of an outboard motor 1 according to a preferred embodiment of the present invention. FIG. 2 is a left side view of the outboard motor 1 from which an apron 14 and a suspension device 4 have been detached. FIG. 3 is a rear view showing an engine cover 13, the apron 14, and an exhaust tube 31. FIG. 4 is a rear view showing a casing 3, the engine cover 13, and the exhaust tube 31.

As shown in FIG. 1, the outboard motor 1 includes an engine 2 that generates power by which a propeller 20 is rotated, a casing 3 that supports the engine 2, and a suspension device 4 that is mounted on the rear of a hull H1.

As shown in FIG. 1, the engine 2 is an internal combustion engine including a crankshaft 5 rotatable around a vertical crankshaft axis Ac. As shown in FIG. 2, the casing 3 is disposed below the engine 2. The casing 3 is made of metal such as an aluminum alloy or steel. The casing 3 includes an exhaust guide 6 disposed below the engine 2, an upper case 7 disposed below the exhaust guide 6, and a lower case 8 disposed below the upper case 7. The engine 2 is supported by the exhaust guide 6. The upper case 7 is connected to the exhaust guide 6, and the lower case 8 is connected to the upper case 7.

As shown in FIG. 1, the suspension device 4 includes a left-and-right pair of clamping brackets 9 that are attached to the hull H1, a tilting shaft 10 supported by the pair of clamping brackets 9 in a posture extending in the right-left direction, and a swivel bracket 11 attached to the tilting shaft 10. The suspension device 4 additionally includes a steering shaft 12 supported by the swivel bracket 11 in a posture extending in the up-down direction.

The steering shaft 12 is rotatable rightwardly and leftwardly around the central axis (i.e., steering axis) of the steering shaft 12 with respect to the swivel bracket 11. The outboard motor body including the engine 2 and the casing 3 rotates rightwardly and leftwardly around the steering axis together with the steering shaft 12. Therefore, the outboard motor body is rotatable rightwardly and leftwardly with respect to the hull H1. Additionally, the swivel bracket 11 is rotatable around the central axis (i.e., tilt axis) of the tilting shaft 10 with respect to the clamping bracket 9 that is attached to the hull H1. The outboard motor body rotates forwardly and rearwardly around the tilt axis together with the swivel bracket 11 and the steering shaft 12. Therefore, the outboard motor body is rotatable forwardly and rearwardly with respect to the hull H1.

As shown in FIG. 1, the outboard motor 1 includes an engine cover 13 with which the engine 2 is covered and an apron 14 with which the casing 3 is covered.

As shown in FIG. 1, the engine cover 13 includes a bottom cover 15 disposed above the casing 3 and a top cover 16 disposed above the bottom cover 15. The bottom cover 15 is attached to the exhaust guide 6, and the top cover 16 is openably and closably attached to the bottom cover 15. At least one portion of the bottom cover 15 and at least one portion of the top cover 16 are made of a material, such as resin, that is lower in strength than the casing 3. The bottom cover 15 has a cup-shaped configuration that is opened upwardly, whereas the top cover 16 has a cup-shaped configuration that is opened downwardly. The opening of the top cover 16 is fitted in the up-down direction to the opening of the bottom cover 15 with a seal S1 (see FIG. 5) therebetween. As a result, a space to contain the engine 2 is provided inside the engine cover 13.

As shown in FIG. 1, the apron 14 is detachably attached to the casing 3. The apron 14 is disposed at a lower position than the engine cover 13. An upper end portion of the apron 14 is disposed along a lower surface 13*a* (see FIG. 3) of the engine cover 13. The apron 14 is disposed at a higher position than the lower case 8. Therefore, the apron 14 is disposed at a height between the engine cover 13 and the lower case 8. The apron 14 is disposed around the upper case 7. An outer surface of the upper case 7 including its side surface and its back surface is covered with the apron 14. As shown in FIG. 3, the apron 14 includes a right apron 14R with which a right side surface of the casing 3 is covered and a left apron 14L with which a left side surface of the casing 3 is covered. At least one portion of the apron 14 is made of a material, such as resin, that is lower in strength than the casing 3. Like the engine cover 13, the apron 14 defines a portion of the outer surface of the outboard motor 1.

As shown in FIG. 1, the outboard motor 1 includes a drive shaft 17 that extends downwardly from the engine 2, a forward/reverse switching mechanism 18 connected to a lower end portion of the drive shaft 17, a propeller shaft 19 connected to the forward/reverse switching mechanism 18, and a propeller 20 detachably attached to the propeller shaft 19.

As shown in FIG. 1, the drive shaft 17, the forward/reverse switching mechanism 18, and the propeller shaft 19 are contained in the casing 3. The drive shaft 17 and the propeller shaft 19 are rotatably supported by the casing 3. The drive shaft 17 extends in the up-down direction in the casing 3. The propeller shaft 19 extends in the front-rear direction in the lower case 8. A rear end portion of the propeller shaft 19 protrudes rearwardly from the lower case 8. The propeller 20 is attached to a projection portion (i.e., rear end portion) of the propeller shaft 19. Therefore, the propeller 20 is disposed behind the lower case 8. The propeller 20 includes an outer cylinder 21 that surrounds the rear end portion of the propeller shaft 19 and a plurality of blades 22 that extend outwardly from the outer cylinder 21. The propeller 20 rotates around the central axis of the propeller shaft 19 together with the propeller shaft 19.

The propeller shaft 19 is rotatable in a normal rotation direction (i.e., clockwise direction when viewed from behind) and in a reverse rotation direction (i.e., direction opposite to the normal rotation direction) with respect to the lower case 8. The drive shaft 17 is driven by the engine 2 in a constant rotation direction. The forward/reverse switching mechanism 18 performs switching among a forward state in which rotation is transmitted from the drive shaft 17 to the propeller shaft 19 such that the propeller shaft 19 rotates in the normal rotation direction, a reverse state in which rotation is transmitted from the drive shaft 17 to the propeller shaft 19 such that the propeller shaft 19 rotates in the reverse rotation direction, and a neutral state in which rotation transmission from the drive shaft 17 to the propeller shaft 19 is cut off. As a result, the rotation direction of the propeller 20 is switched, and the direction of a thrust generated by the propeller 20 is changed.

As shown in FIG. 1, the forward/reverse switching mechanism 18 includes a pinion 23 that rotates around the central axis of the drive shaft 17 together with the drive shaft 17, a front gear 24 and a rear gear 25 each of which engages the pinion 23, and a dog clutch 26 with which the front gear 24 or the rear gear 25 are selectively engaged.

As shown in FIG. 1, the pinion 23, the front gear 24, and the rear gear 25 are all bevel gears. The pinion 23 is disposed on the central axis of the drive shaft 17, and the front gear 24 and the rear gear 25 are disposed on the central axis of the propeller shaft 19. The front gear 24 is disposed in front of the central axis of the drive shaft 17, and the rear gear 25 is disposed behind the central axis of the drive shaft 17. The dog clutch 26 is disposed between the front gear 24 and the rear gear 25. The front gear 24, the rear gear 25, and the dog clutch 26 surround the propeller shaft 19.

As shown in FIG. 1, the front gear 24 and the rear gear 25 are supported by the lower case 8 rotatably around the central axis of the propeller shaft 19. The pinion 23 rotates around the central axis of the drive shaft 17 together with the drive shaft 17. The front gear 24 and the rear gear 25 rotate in mutually opposite directions when the drive shaft 17 rotates. The dog clutch 26 is spline-connected to the propeller shaft 19. The dog clutch 26 rotates around the central axis of the propeller shaft 19 together with the propeller shaft 19, and is movable in the axial direction of the propeller shaft 19 with respect to the propeller shaft 19. The rotation of the drive shaft 17 is transmitted to the dog clutch 26 and the propeller shaft 19 via the front gear 24 or the rear gear 25.

The dog clutch 26 is selectively disposed at a shift position, which is anyone of forward, reverse, and neutral positions, by a shift mechanism (not shown). The forward position, the reverse position, and the neutral position correspond to the forward state, the reverse state, and the neutral state, respectively. The forward position is a position at which the front gear 24 engages the dog clutch 26, and the reverse position is a position at which the rear gear 25 engages the dog clutch 26. The neutral position (which is shown in FIG. 1) is a position at which the dog clutch 26 engages neither the front gear 24 nor the rear gear 25. In a state in which the dog clutch 26 is located at the forward position, the rotation of the drive shaft 17 is transmitted to the propeller shaft 19 through the pinion 23, the front gear 24, and the dog clutch 26. On the contrary, in a state in which the dog clutch 26 is located at the reverse position, the rotation of the drive shaft 17 is transmitted to the propeller shaft 19 through the pinion 23, the rear gear 25, and the dog clutch 26.

As shown in FIG. 1, the outboard motor 1 includes a main exhaust passage 28 through which exhaust gases of the engine 2 are guided to a main exhaust port 27 opened in water and an idle exhaust passage 30 through which exhaust gases in the main exhaust passage 28 are guided to an idle exhaust port 29 opened to the atmosphere.

As shown in FIG. 1, the main exhaust passage 28 extends downwardly from the engine 2. The drive shaft 17 and the forward/reverse switching mechanism 18 are disposed in front of the main exhaust passage 28. The main exhaust passage 28 extends downwardly from the engine 2 to the propeller shaft 19, and extends rearwardly along the propeller shaft 19. The main exhaust passage 28 is defined by the casing 3 which defines and serves as an exhaust passage member. The main exhaust passage 28 extends through the inside of the exhaust guide 6, the inside of the upper case 7, and the inside of the lower case 8, and is opened at a back surface (a rear surface) of the lower case 8. The inside (i.e., an inner space of the outer cylinder 21) of the propeller 20 is connected to an end of the main exhaust passage 28 opened at the back surface of the lower case 8. The main exhaust port 27 is defined by the propeller 20 (i.e., by the rear end portion of the outer cylinder 21). Therefore, the main exhaust passage 28 leads to the main exhaust port 27 opened rearwardly at the rear end portion of the propeller 20.

As shown in FIG. 1, the idle exhaust passage 30 is disposed at a lower position than the engine 2. The idle exhaust passage 30 diverges from the main exhaust passage 28 in the casing 3. Therefore, the idle exhaust passage 30 is connected to the main exhaust passage 28. A portion of the idle exhaust passage 30 is defined by the casing 3. The outboard motor 1 includes an exhaust tube 31 that defines a portion of the idle exhaust passage 30. The casing 3 that serves as an exhaust passage member defines an upstream portion of the idle exhaust passage 30, and the exhaust tube 31 that serves as an idle exhaust passage member defines a downstream portion of the idle exhaust passage 30 through which the idle exhaust port 29 and an upstream portion of the idle exhaust passage 30 defined by the casing 3 are connected to each other.

As shown in FIG. 2, the exhaust tube 31 is disposed below the engine cover 13. The exhaust tube 31 extends rearwardly and upwardly from the casing 3. The exhaust tube 31 is shorter in the front-rear direction than the casing 3 and the engine cover 13. The exhaust tube 31 includes a cylindrical upstream end portion 31U that extends in the front-rear direction, a cylindrical midstream portion 31M that extends rearwardly and upwardly from the rear end of the upstream end portion 31U, and a cylindrical downstream end portion 31D that extends rearwardly from the rear end of the midstream portion 31M. The exhaust tube 31 additionally includes an upstream opening 31*a* (see FIG. 8) that is opened forwardly at the upstream end of the exhaust tube 31 and a downstream opening 31*b* that is opened rearwardly at the downstream end of the exhaust tube 31. The downstream opening 31*b* is an opening corresponding to the idle exhaust port 29. The opening area of the downstream opening 31*b* is preferably smaller than that of the upstream opening 31*a* (see FIG. 8).

As shown in FIG. 2, the downstream end portion 31D of the exhaust tube 31 corresponding to the rear end portion of the exhaust tube 31 is disposed at a higher position than the upstream end portion 31U of the exhaust tube 31 corresponding to the front end portion of the exhaust tube 31. Therefore, the downstream end of the exhaust tube 31 is disposed at a higher position than the upstream end of the exhaust tube 31. As shown in FIG. 1, a lower end 10*a* of the tilting shaft 10 is disposed at a lower position than the downstream end of the exhaust tube 31. The idle exhaust port 29 is defined by the downstream end of the exhaust tube 31. Therefore, the idle exhaust port 29 is disposed at a higher position than the lower end 10*a* of the tilting shaft 10. Additionally, the propeller 20 is disposed at a lower position than the exhaust tube 31. Therefore, the idle exhaust port 29 is disposed at a higher position than the main exhaust port 27.

As shown in FIG. 2, the upstream end portion 31U of the exhaust tube 31 is supported by the casing 3. The downstream end portion 31D of the exhaust tube 31 is supported by the engine cover 13. Therefore, the exhaust tube 31 is supported by the casing 3 and the engine cover 13. The downstream end portion 31D of the exhaust tube 31 is disposed below the engine cover 13 along a lower surface 13*a* of the engine cover 13. As shown in FIG. 1 and FIG. 3, the downstream end portion 31D of the exhaust tube 31 extends through a space between the lower end portion of the engine cover 13 and the upper end portion of the apron 14 in the up-down direction, and protrudes rearwardly from the apron 14. The downstream end of the exhaust tube 31 is disposed at a more rearward position than the lower end portion of the engine cover 13, i.e., than the lower end portion of the bottom cover 15. Therefore, the idle exhaust port 29 is disposed at a more rearward position than the outer surface of the outboard motor 1 below the idle exhaust port 29.

As shown in FIG. 3, the downstream end portion 31D of the exhaust tube 31 that defines the idle exhaust port 29 is exposed from the engine cover 13 and the apron 14. Therefore, the downstream end portion 31D of the exhaust tube 31 is exposed from the outer surface of the outboard motor 1. The downstream end portion 31D of the exhaust tube 31 is disposed between the engine cover 13 and the apron 14 in the up-down direction. The downstream end portion 31D of the exhaust tube 31 is disposed in a concave portion 14*a* that is cut downwardly from the upper end portion of the apron 14. The concave 14*a* is cut downwardly from the upper end portion of the apron 14, and penetrates the apron 14 in its thickness direction. Therefore, the apron 14 is disposed on the right, left, and lower sides of the downstream end portion 31D of the exhaust tube 31. The downstream end portion 31D of the exhaust tube 31 is supported by the lower end portion of the engine cover 13 such that it does not contact the apron 14.

As shown in FIG. 4, the exhaust tube 31 is shorter than the casing 3 and the engine cover 13 in the up-down direction. Additionally, the exhaust tube 31 is shorter than the casing 3 and the engine cover 13 in the right-left direction (i.e., in the width direction). The exhaust tube 31 is disposed inside the right end and the left end of the engine cover 13 (in a direction of the approach to a widthwise center C1 of the outboard motor 1). Likewise, the exhaust tube 31 is disposed inside the right end and the left end of the exhaust guide 6. The exhaust tube 31 is disposed at a position at which it coincides with the widthwise center C1 of the outboard motor 1 (i.e., with a vertical plane by which the outboard motor 1 is halved in the width direction). Without being limited to the position at which it coincides with the widthwise center C1, the exhaust tube 31 may be disposed outside the widthwise center C1 (in a direction of recession from the widthwise center C1).

As mentioned above, the main exhaust port 27 is defined by the propeller 20 disposed in water. Therefore, the main exhaust port 27 is disposed in water. On the other hand, the idle exhaust port 29 is defined by the exhaust tube 31 disposed at a higher position than the propeller 20. As shown in FIG. 1, the idle exhaust port 29 is disposed at a higher position than a water surface (waterline WL) when a vessel provided with the outboard motor 1 stops. Therefore, the idle exhaust port 29 is disposed in the atmosphere. The opening area of the idle exhaust port 29 is smaller than that of the main exhaust port 27. Additionally, the maximum flow passage area (i.e., area perpendicular or substantially perpendicular to a flow direction) of the idle exhaust passage 30 is smaller than the minimum flow passage area of the main exhaust passage 28. Therefore, the idle exhaust passage 30 is thinner than the main exhaust passage 28.

When the engine 2 emits a high output, water that has entered the main exhaust passage 28 through the main exhaust port 27 is pushed out of the main exhaust port 27 by exhaust gases discharged from the engine 2 into the main exhaust passage 28. As a result, the exhaust gases of the engine 2 are guided to the main exhaust port 27 by the main exhaust passage 28, and are discharged into the water from the main exhaust port 27 corresponding to the outlet of the main exhaust passage 28. Simultaneously, a portion of the exhaust gases in the main exhaust passage 28 are guided to the idle exhaust port 29 by the idle exhaust passage 30, and are discharged into the atmosphere from the idle exhaust port 29 corresponding to the outlet of the idle exhaust passage 30.

On the other hand, when the engine 2 emits a low output (for example, during idling), the flow quantity of exhaust gases discharged from the engine 2 into the main exhaust passage 28 is smaller than during high output operation (i.e., when the engine 2 emits a high output), and therefore the atmospheric pressure of the inside of the main exhaust passage 28 is lower than during high output operation. Therefore, the exhaust gases in the main exhaust passage 28 are hardly discharged from the main exhaust port 27, and are discharged into the atmosphere mainly through the idle exhaust port 29. When the exhaust gases are discharged into water from the main exhaust port 27, air bubbles are generated in the water, and a sound is produced. When the output of the engine 2 is low, the exhaust gases are hardly discharged from the main exhaust port 27, and therefore the noise is reduced.

Figure 5:
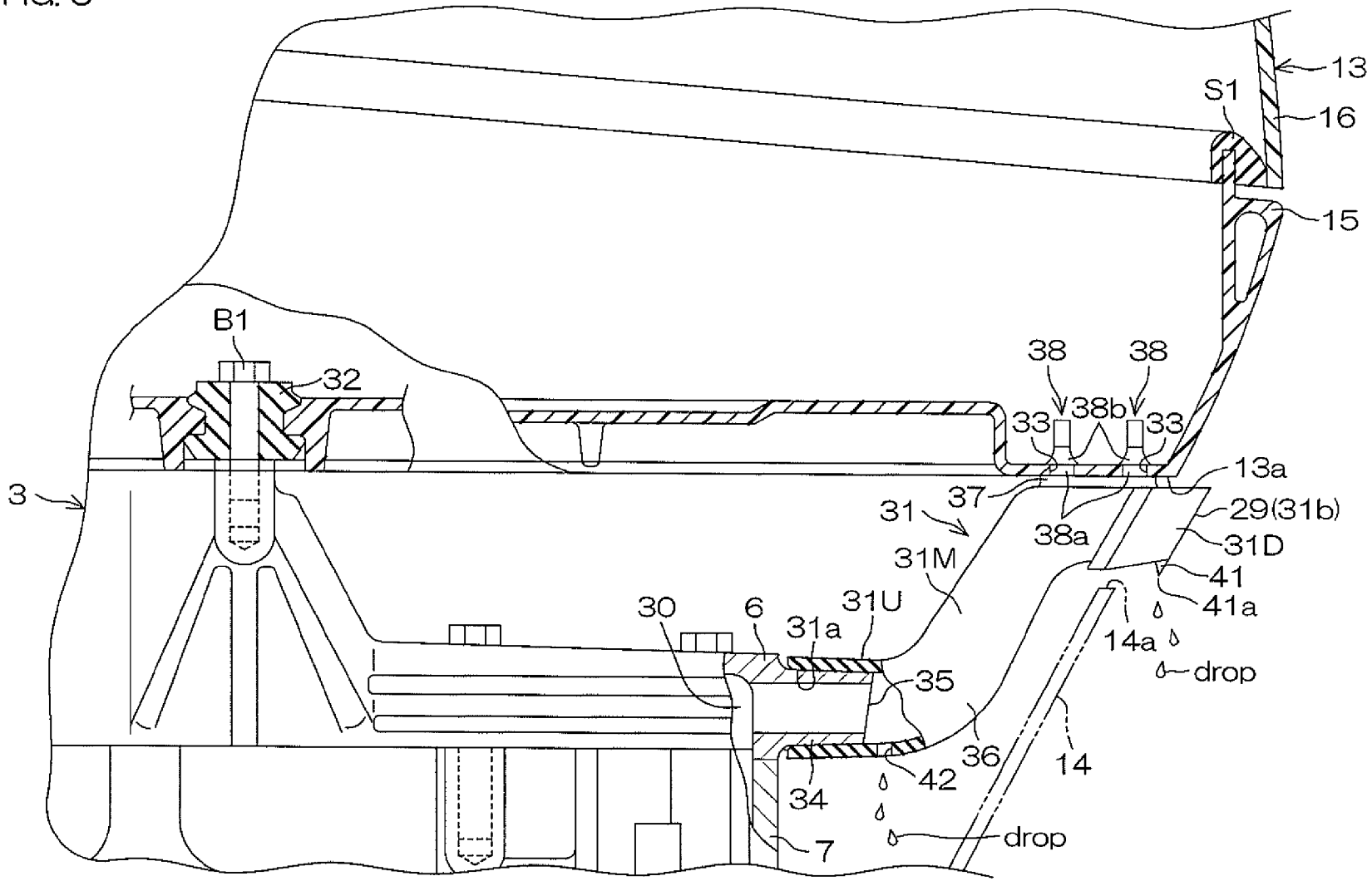
FIG. 5 is a partial sectional view showing the casing, the engine cover, and the exhaust tube.
Figure 6:
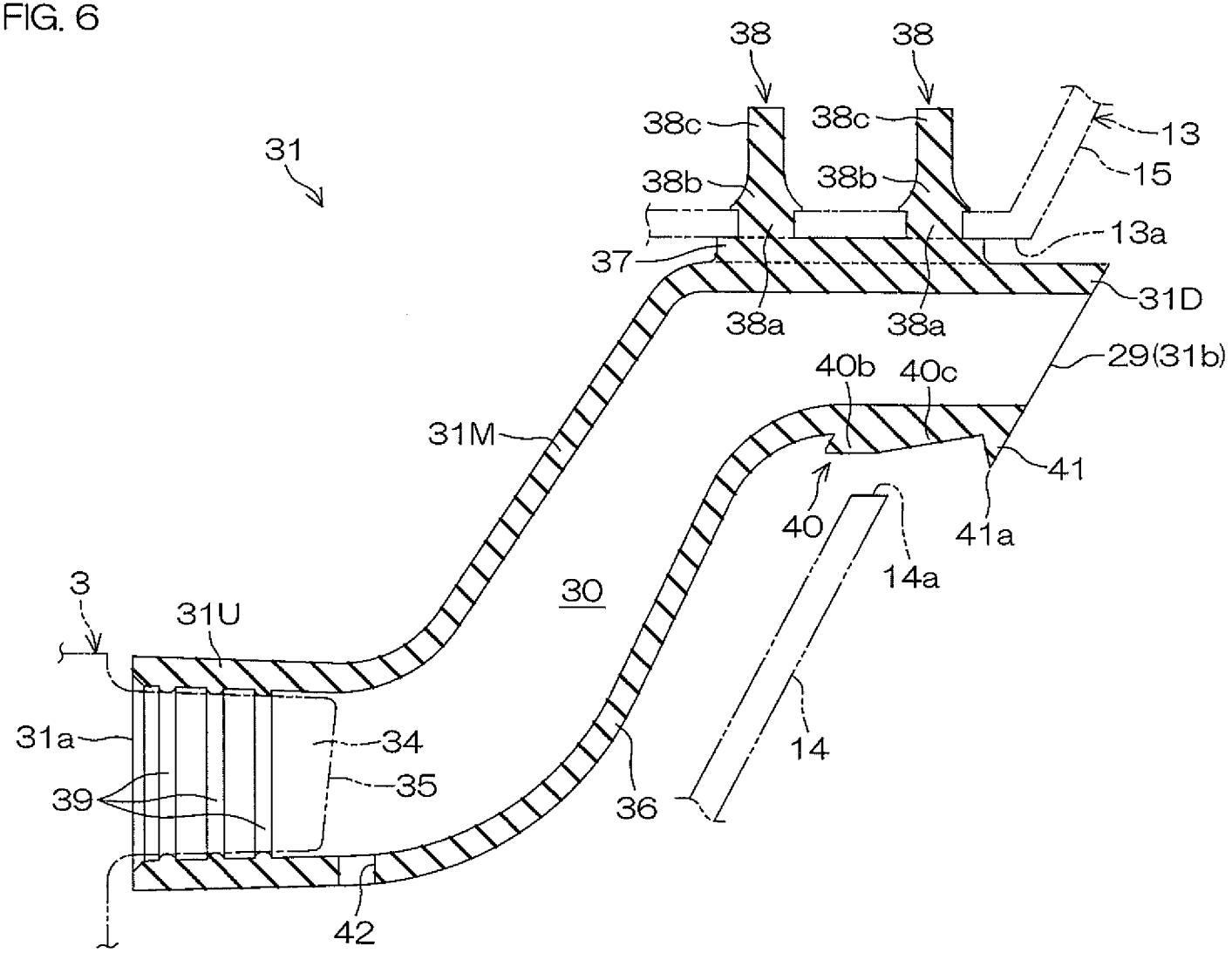
FIG. 6 is a sectional view of the exhaust tube.
Figure 7:
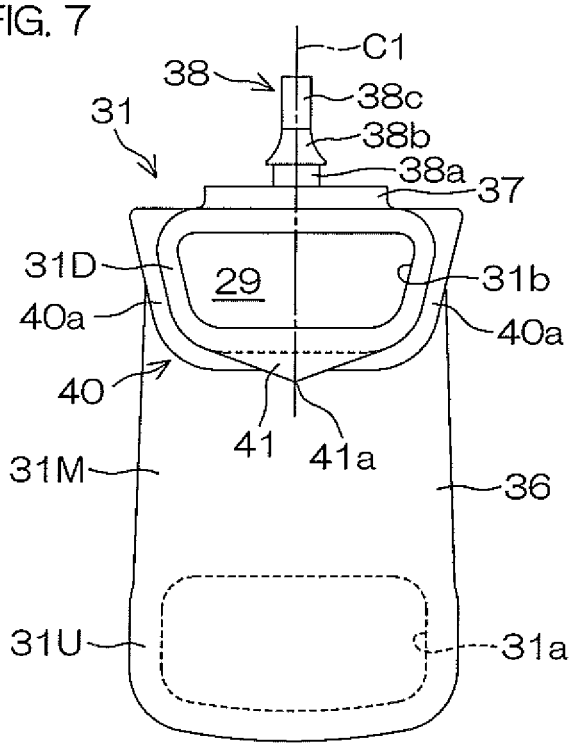
FIG. 7 is a rear view of the exhaust tube.
Figure 8:
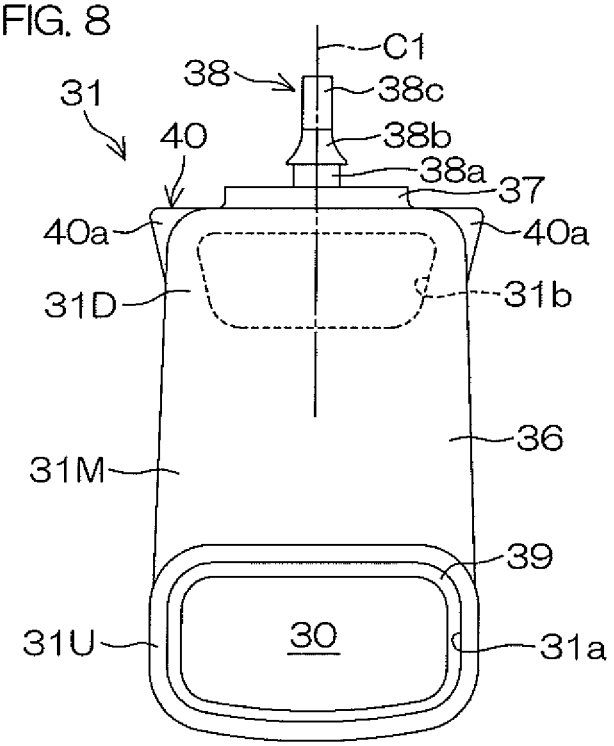
FIG. 8 is a front view of the exhaust tube.
Figure 9:
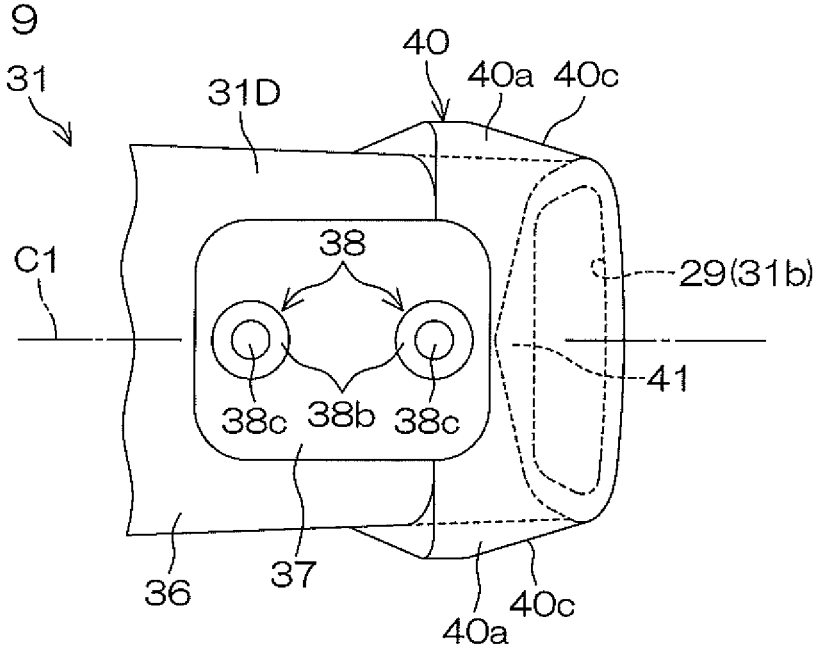
FIG. 9 is a plan view of a portion of the exhaust tube.

FIG. 5 is a partial sectional view showing the casing 3, the engine cover 13, and the exhaust tube 31. FIG. 6 is a sectional view of the exhaust tube 31. FIG. 7 is a rear view of the exhaust tube 31. FIG. 8 is a front view of the exhaust tube 31. FIG. 9 is a plan view of a portion of the exhaust tube 31. FIG. 6 shows a cross-section of the exhaust tube 31 along the widthwise center C1.

As shown in FIG. 5, the outboard motor 1 includes a bolt B1 with which the engine cover 13 is fastened to the casing 3 and a grommet 32 that is interposed between the bolt B1 and the engine cover 13.

As shown in FIG. 5, the grommet 32 is attached to a through-hole that penetrates the bottom cover 15 in the up-down direction. The grommet 32 is a ring made of a material, such as resin or rubber, which is lower in strength than the engine cover 13. The bolt B1 is inserted into the grommet 32 from above. A shank of the bolt B1 protrudes downwardly from the bottom cover 15. A projection portion (lower end portion) of the shank of the bolt B1 is attached to a threaded hole provided in the exhaust guide 6. As a result, the bottom cover 15 is detachably attached to the exhaust guide 6. The bottom cover 15 is attached to the exhaust guide 6 by the bolt B1 at a more forward position than the rear end portion of the bottom cover 15. The exhaust tube 31 is disposed at a more rearward position than the bolt B1.

As shown in FIG. 5, the outboard motor 1 includes a downstream-side mounting structure arranged to attach the downstream end portion 31D of the exhaust tube 31 to the engine cover 13. The downstream-side mounting structure includes one or more mounting holes 33 that extend upwardly from the lower surface 13*a* of the engine cover 13 and one or more mounting projections 38 that extend upwardly from the downstream end portion 31D of the exhaust tube 31. FIG. 5 shows an example in which two mounting holes 33 and two mounting projections 38 are provided.

As shown in FIG. 5, the two mounting projections 38 extend upwardly from a plate-shaped pedestal portion 37 disposed on an upper portion of the downstream end portion 31D of the exhaust tube 31. The upper ends of the two mounting projections 38 are disposed at a height equal or substantially equal to each other, and the lower ends of the two mounting projections 38 are disposed at a height equal or substantially equal to each other. The two mounting projections 38 are disposed in parallel or substantially in parallel. The two mounting projections 38 are arranged side by side in the front-rear direction. Each of the two mounting projections 38 is disposed at a higher position than the idle exhaust port 29 and at a more forward position than the idle exhaust port 29. As shown in FIG. 9, the two mounting projections 38 are disposed at positions, respectively, at which they coincide with the widthwise center C1 of the exhaust tube 31 (i.e., with a vertical plane by which the exhaust tube 31 is halved in the width direction).

As shown in FIG. 6, the mounting projection 38 includes a thick shaft portion 38*a* that extends upwardly from the pedestal portion 37 disposed on the downstream end portion 31D of the exhaust tube 31, a taper portion 38*b* that extends upwardly from the thick shaft portion 38*a*, and a thin shaft portion 38*c* that extends upwardly from the taper portion 38*b*. The thick shaft portion 38*a*, the taper portion 38*b*, and the thin shaft portion 38*c* are coaxial, and are disposed on a vertical, common straight line. The outer diameter of the thick shaft portion 38*a* is greater than that of the thin shaft portion 38*c*. The thin shaft portion 38*c* is longer in the axial direction than the thick shaft portion 38*a* and the taper portion 38*b*. The taper portion 38*b* has a truncated cone-shaped configuration that is tapered toward the upper end of the mounting projection 38. The maximum diameter of the taper portion 38*b* (i.e., outer diameter of the lower end portion of the taper portion 38*b*) is greater than the outer diameter of the thick shaft portion 38*a*. The lower end portion of the taper portion 38*b* protrudes more outwardly than the thick shaft portion 38*a* over the whole circumference of the mounting projection 38.

When the downstream end portion 31D of the exhaust tube 31 is attached to the engine cover 13 as shown in FIG. 5, the mounting projection 38 is inserted from below into the mounting hole 33 that penetrates the bottom cover 15 of the engine cover 13 in the up-down direction. At this time, the mounting projection 38 is guided upwardly by the outer peripheral surface of the taper portion 38*b* and the inner peripheral surface of the mounting hole 33. The taper portion 38*b* is disposed at a higher position than the mounting hole 33. The inner diameter of the mounting hole 33 is smaller than the maximum diameter of the taper portion 38*b*. Therefore, contact between the lower end portion of the taper portion 38*b* and an upper surface of a bottom portion of the bottom cover 15 prevents the mounting projection 38 from detaching from the engine cover 13. As a result, the downstream end portion 31D of the exhaust tube 31 is stably held by the engine cover 13.

As shown in FIG. 5, the outboard motor 1 includes an upstream-side mounting structure arranged to attach the upstream end portion 31U of the exhaust tube 31 to the casing 3. The upstream-side mounting structure includes a cylindrical projection 34 disposed in the casing 3. As shown in FIG. 6, the upstream-side mounting structure additionally includes one or more annular projections 39 disposed on the inner peripheral surface of the exhaust tube 31. FIG. 6 shows an example in which three annular projections 39 are provided in the exhaust tube 31.

As shown in FIG. 5, the cylindrical projection 34 is located at the exhaust guide 6. The cylindrical projection 34 may be located at the upper case 7. The cylindrical projection 34 extends in the front-rear direction. The inner peripheral surface of the cylindrical projection 34 defines a portion of the idle exhaust passage 30. The cylindrical projection 34 includes an intermediate exhaust port 35 that is opened rearwardly. The upstream end portion 31U of the exhaust tube 31 is fitted to the outer periphery of the cylindrical projection 34. The intermediate exhaust port 35 is disposed in an internal space of the exhaust tube 31. Therefore, the opening area of the intermediate exhaust port 35 is smaller than that of the upstream opening 31*a* that is opened at the upstream end of the exhaust tube 31.

As shown in FIG. 6, three annular projections 39 are disposed at the upstream end portion 31U of the exhaust tube 31. The three annular projections 39 are spaced apart in a direction along the center line of the exhaust tube 31. The annular projections 39 protrude inwardly from the inner peripheral surface of the exhaust tube 31. The annular projections 39 are continuous over the whole circumference of the annular projections 39 in such a manner as to surround the center line of the exhaust tube 31 (see FIG. 8). The annular projections 39 are elastically deformable. The annular projections 39 are disposed around the cylindrical projection 34. The inner diameter of the annular projections 39 in a free state (i.e., state in which a load is not applied) is smaller than the outer diameter of the cylindrical projection 34.

When the cylindrical projection 34 is inserted in the upstream end portion 31U of the exhaust tube 31, the annular projections 39 are elastically deformed outwardly in the radial direction, so that the cylindrical projection 34 is tightened inwardly in the radial direction. Therefore, the exhaust tube 31 is prevented from detaching from the cylindrical projection 34. Additionally, the annular projections 39 are in close contact with the outer peripheral surface of the cylindrical projection 34, and therefore sealing is achieved between the inner peripheral surface of the exhaust tube 31 and the outer peripheral surface of the cylindrical projection 34. Therefore, a gas or a liquid can be prevented from leaking from between the exhaust tube 31 and the cylindrical projection 34, or can be prevented from entering a space between the exhaust tube 31 and the cylindrical projection 34.

As shown in FIG. 6, the exhaust tube 31 is a single cylindrical member that extends from the casing 3 to the idle exhaust port 29. Therefore, the exhaust tube 31 is an integrally formed element from the upstream end of the exhaust tube 31 to the downstream end of the exhaust tube 31. The exhaust tube 31 is more flexible than the engine cover 13, and is elastically deformed with a weaker force than the engine cover 13. In other words, the exhaust tube 31 is made of a flexible material that is lower in strength than the engine cover 13. The flexible material may be an elastic material, such as rubber or resin, or may be a material other than an elastic material. FIG. 6 shows an example in which the exhaust tube 31 is made of rubber.

As shown in FIG. 6, the exhaust tube 31 includes a cylindrical portion 36 that extends from the casing 3 to the idle exhaust port 29, a pedestal portion 37 that is disposed at the downstream end portion 31D of the exhaust tube 31, amounting projection 38 that extends upwardly from the pedestal portion 37, and annular projections 39 that are disposed on the inner peripheral surface of the exhaust tube 31. The exhaust tube 31 additionally includes a thick-walled portion 40 disposed at the downstream end portion 31D of the exhaust tube 31 and a liquid guide 41 disposed below the idle exhaust port 29. The cylindrical portion 36, the pedestal portion 37, the mounting projection 38, the annular projections 39, the thick-walled portion 40, and the liquid guide 41 are integrally formed, and are joined together so as not to be separated from each other without being destroyed.

As shown in FIG. 6, the cylindrical portion 36 extends rearwardly from the cylindrical projection 34. The pedestal portion 37 is disposed above the rear end portion of the cylindrical portion 36. The inner peripheral surface of the cylindrical portion 36 corresponding to the inner peripheral surface of the exhaust tube 31 defines a downstream portion of the idle exhaust passage 30 through which the idle exhaust port 29 and a portion of the idle exhaust passage 30 defined by the casing 3 are connected together. Therefore, exhaust gases discharged from the casing 3 are discharged into the atmosphere from the idle exhaust port 29 through the inside of the cylindrical portion 36. The cross-sectional area of the internal space of the cylindrical portion 36, i.e., the flow passage area of the exhaust tube 31 may be constant from the upstream opening 31*a* to the downstream opening 31*b*, or may vary between the upstream opening 31*a* and the downstream opening 31*b*.

As shown in FIG. 6, the cylindrical portion 36 includes a drainage port 42 through which the idle exhaust passage 30 is connected to the outside of the exhaust tube 31. The drainage port 42 is disposed at the upstream end portion 31U of the exhaust tube 31 corresponding to the front end portion of the cylindrical portion 36. The drainage port 42 extends downwardly from the lower end portion of the inner peripheral surface of the exhaust tube 31, and penetrates the exhaust tube 31. As a result, the idle exhaust passage 30 is connected to the outside of the exhaust tube 31. The drainage port 42 is disposed at a more rearward position than the cylindrical projection 34 disposed in the casing 3. The drainage port 42 is disposed at a lower position than the intermediate exhaust port 35 disposed at the cylindrical projection 34.

There is a possibility that water (condensed water) that contains carbon or sulfur will be generated in the outboard motor 1 when exhaust gases in the outboard motor 1 are cooled. Therefore, there is a possibility that water containing carbon or sulfur will enter the exhaust tube 31 from the casing 3. Additionally, there is a possibility that water outside the outboard motor 1 that contains foreign substances, such as salt, will enter the exhaust tube 31 through the idle exhaust port 29 because the idle exhaust port 29 is in an exposed state. Water inside the exhaust tube 31 gathers at the upstream end portion 31U of the exhaust tube 31 corresponding to the lower end portion. Thereafter, water that has reached the upstream end portion 31U of the exhaust tube 31 is discharged outwardly from the exhaust tube 31 through the drainage port 42. As a result, the volume of water in the exhaust tube 31 is reduced, and the contamination of the inside of the exhaust tube 31 is prevented.

As shown in FIG. 7, the thick-walled portion 40 is disposed beside and below the rear end portion of the cylindrical portion 36. The thick-walled portion 40 has a U-shaped configuration that is upwardly opened when viewed from behind. The thick-walled portion 40 includes a pair of lateral portions 40*a* disposed on the right and left sides of the rear end portion of the cylindrical portion 36, respectively, and a lower portion 40*b* disposed below the rear end portion of the cylindrical portion 36. The liquid guide 41 is disposed behind the lower portion 40*b*. Therefore, the liquid guide 41 coincides with the lower portion 40*b* when viewed from behind. A lower end 41*a* of the liquid guide 41 is disposed at a lower position than the thick-walled portion 40. As shown in FIG. 6 and FIG. 9, the lateral portion 40*a* and the lower portion 40*b* include an inclined portion 40*c* that is inclined such that its thickness becomes smaller in proportion as it approaches to the rear end surface of the exhaust tube 31.

As shown in FIG. 7, the liquid guide 41 extends downwardly from the idle exhaust port 29. The liquid guide 41 has an inverted triangle-shaped configuration when viewed from behind. The liquid guide 41 is shorter in the up-down direction than the idle exhaust port 29. The liquid guide 41 coincides with the widthwise center C1 of the exhaust tube 31. The lower end 41*a* of the liquid guide 41 is disposed at a position at which it coincides with the widthwise center C1 of the exhaust tube 31. The lower end 41*a* of the liquid guide 41 may be disposed outside the widthwise center C1 of the exhaust tube 31 (i.e., disposed on the right or left side thereof).

As shown in FIG. 7, the lower end 41*a* of the liquid guide 41 is shorter in the right-left direction than the other portions of the liquid guide 41. Additionally, as shown in FIG. 6, the lower end 41*a* of the liquid guide 41 is shorter in the front-rear direction than the other portions of the liquid guide 41. Therefore, the liquid guide 41 is tapered toward the lower end 41*a* of the liquid guide 41. The liquid guide 41 may be tapered continuously, or may be tapered step by step.

As shown in FIG. 7, the rear end surface of the liquid guide 41 extends to the rear end surface of the exhaust tube 31. As shown in FIG. 6, the rear end surface of the liquid guide 41 and the rear end surface of the exhaust tube 31 are disposed on the same plane. The rear end surface of the exhaust tube 31 is inclined in the front-rear direction so that its upper end is located at a more rearward position than its lower end. Likewise, the rear end surface of the liquid guide 41 is inclined in the front-rear direction so that its upper end is located at a more rearward position than its lower end. Therefore, an annular end surface of the exhaust tube 31 surrounding the idle exhaust port 29 is inclined downwardly.

As shown in FIG. 5, the liquid guide 41 is disposed at a more rearward position than the lower end portion of the engine cover 13 and the upper end portion of the apron 14. Therefore, the liquid guide 41 is disposed at a more rearward position than the outer surface of the apron 14. The liquid guide 41 is disposed at a lower position than the engine cover 13. Additionally, the liquid guide 41 is disposed at a higher position than the bottom of the concave portion 14*a* disposed at the upper end portion of the apron 14. The apron 14 is disposed behind the upstream end portion 31U and the midstream portion 31M of the exhaust tube 31. The upstream end portion 31U and the midstream portion 31M of the exhaust tube 31 are covered from behind and from the sides by the apron 14.

As shown in FIG. 5, water adhering to the outer peripheral surface or the rear end surface of the exhaust tube 31 flows downwardly by gravitation. There is a possibility that water in the exhaust tube 31 that has reached the vicinity of the idle exhaust port 29 will move to the rear end surface of the exhaust tube 31, and will flow downwardly along the rear end surface of the exhaust tube 31. Therefore, the water gathers at the liquid guide 41 disposed below the idle exhaust port 29. Thereafter, the water that has moved to the liquid guide 41 flows downwardly along the outer surface of the liquid guide 41, and gathers at the lower end 41*a* of the liquid guide 41. The liquid guide 41 is tapered toward the lower end 41*a* of the liquid guide 41. Therefore, the water that has gathered at the lower end 41*a* of the liquid guide 41 forms liquid droplets, and these droplets fall from the lower end 41*a* of the liquid guide 41.

As shown in FIG. 5, the liquid guide 41 is disposed at a more rearward position than the outer surface of the apron 14. Therefore, it is difficult for the liquid droplets that have fallen from the liquid guide 41 to adhere to the outer surface of the apron 14. Furthermore, the rear of the outer surface of the apron 14 is inclined downwardly so as to recede from the liquid guide 41. Therefore, it is more difficult for the liquid droplets that have fallen from the liquid guide 41 to adhere to the outer surface of the apron 14. There is a possibility that foreign substances, such as carbon, sulfur, or salt, will be contained in the water adhering to the liquid guide 41. When this water dries on the outer surface of the apron 14, deposits remain on the apron 14 in the form of dirt. Therefore, the dirt on the outer surface of the outboard motor 1 can be reduced by preventing water from adhering to the outer surface of the apron 14.

As described above, in the present preferred embodiment, the idle exhaust port 29 corresponding to the outlet of the idle exhaust passage 30 is defined by the downstream end of the exhaust tube 31. The downstream end of the exhaust tube 31 is disposed at a higher position than the upstream end of the exhaust tube 31. Therefore, it is possible to dispose the idle exhaust port 29 at a high position on the outboard motor. Therefore, it is difficult for a spray of water to enter the idle exhaust passage 30 from the idle exhaust port 29, and it is difficult for the idle exhaust port 29 to be submerged in water. This makes it possible to reduce the amount of water entering the idle exhaust passage 30 from the idle exhaust port 29.

Additionally, the exhaust tube 31 preferably is a single member integrally formed from its upstream end to its downstream end. Therefore, it is possible to reduce the number of components of the outboard motor 1. This makes it possible to reduce the production time and production costs required to produce the outboard motor 1. Additionally, the exhaust tube 31 is made of a flexible material, and therefore it is possible for the exhaust tube 31 to move with the vibrations of the casing 3. This makes it possible to reduce the amount of positional deviation of the exhaust tube 31 and to prevent the detachment of the exhaust tube 31 from the casing 3.

Additionally, in the present preferred embodiment, the downstream end portion 31D of the exhaust tube 31 is supported by the engine cover 13 with which the engine 2 is covered. Therefore, the exhaust tube 31 is supported by the casing 3 and the engine cover 13. As mentioned above, the exhaust tube 31 is made of a flexible material. Therefore, even if the casing 3 and the engine cover 13 vibrate or even if the casing 3 and the engine cover 13 move relative to each other, the exhaust tube 31 can follow or move with these movements. This makes it possible to reduce the amount of positional deviation of the exhaust tube 31 and to prevent the detachment of the exhaust tube 31 from the casing 3 and from the engine cover 13.

Additionally, in the present preferred embodiment, the downstream end of the exhaust tube 31 that defines the idle exhaust port 29 is disposed at a more rearward position than the lower end portion of the engine cover 13. The idle exhaust port 29 is opened to the atmosphere, and is easily exposed to a spray of water. Therefore, there is a possibility that water that has adhered to the exhaust tube 31 will fall from the idle exhaust port 29. Additionally, there is another possibility that water in the exhaust tube 31 will fall from the idle exhaust port 29. The idle exhaust port 29 is disposed at a more rearward position than the outer surface of the outboard motor 1 below the idle exhaust port 29. Therefore, it is difficult for water that has fallen from the idle exhaust port 29 to adhere to the outer surface of the outboard motor 1. This makes it possible to reduce the contamination of the outboard motor 1.

Additionally, in the present preferred embodiment, the downstream end portion 31D of the exhaust tube 31 is disposed below the engine cover 13 and along the lower surface 13*a* of the engine cover 13. Therefore, the idle exhaust port 29 is disposed at a high position on the outboard motor 1. Therefore, it is difficult for a spray of water to enter the idle exhaust passage 30 from the idle exhaust port 29, and it is difficult for the idle exhaust port 29 to be submerged in water. This makes it possible to reduce the amount of water entering the idle exhaust passage 30 from the idle exhaust port 29.

Additionally, in the present preferred embodiment, the casing 3 is covered with the apron 14. The downstream end portion 31D of the exhaust tube 31 extends through a space between the engine cover 13 and the apron 14, and protrudes rearwardly from the apron 14. Therefore, at least one portion of the downstream end portion 31D of the exhaust tube 31 is disposed at a more rearward position than the outer surface of the apron 14. Therefore, it is difficult for water that has fallen from the idle exhaust port 29 to adhere to the outer surface of the apron 14. Additionally, the downstream end portion 31D of the exhaust tube 31 is supported by the engine cover 13 such that it does not contact the apron 14, and therefore vibrations of the apron 14 are not transmitted to the downstream end portion 31D of the exhaust tube 31. Therefore, the positional deviation of the downstream end portion 31D of the exhaust tube 31 can be made even smaller.

Additionally, in the present preferred embodiment, the liquid guide 41 disposed below the idle exhaust port 29 is provided on the exhaust tube 31. Water adhering to the outer surface of the downstream end portion 31D of the exhaust tube 31 or water in the exhaust tube 31 that has reached the vicinity of the idle exhaust port 29 gathers at the liquid guide 41 disposed below the idle exhaust port 29. Thereafter, the water that has moved to the liquid guide 41 flows downwardly along the outer surface of the liquid guide 41, and gathers at the lower end 41*a* of the liquid guide 41. The liquid guide 41 is tapered toward the lower end 41*a* of the liquid guide 41. Therefore, the water that has gathered at the lower end 41*a* of the liquid guide 41 forms liquid droplets, and these droplets fall from the lower end 41*a* of the liquid guide 41. The liquid guide 41 is disposed at a more rearward position than the outer surface of the apron 14. Therefore, it is difficult for the liquid droplets that have fallen from the liquid guide 41 to adhere to the outer surface of the apron 14. Therefore, the contamination of the apron 14 can be reduced.

Additionally, in the present preferred embodiment, the mounting projection 38 extending upwardly from the downstream end portion 31D of the exhaust tube 31 is inserted into the mounting hole 33 extending upwardly from the lower surface 13*a* of the engine cover 13. As a result, the downstream end portion 31D of the exhaust tube 31 is attached to the engine cover 13. Therefore, the downstream end portion 31D of the exhaust tube 31 can be attached to the engine cover 13 by performing an easy operation to insert the mounting projection 38 into the mounting hole 33, and therefore it is possible to make the production time required to produce the outboard motor 1 even shorter. This makes it possible to reduce the production costs of the outboard motor 1.

Additionally, in the present preferred embodiment, the cylindrical projection 34 including the inner peripheral surface that defines a portion of the idle exhaust passage 30 is disposed one the casing 3. The upstream end portion 31U of the exhaust tube 31 is attached to the casing 3 by fitting the upstream end portion 31U of the exhaust tube 31 to the cylindrical projection 34. The upstream end portion 31U of the exhaust tube 31 may be fitted to the outer periphery of the cylindrical projection 34, or may be fitted to the inner periphery of the cylindrical projection 34. Therefore, the upstream end portion 31U of the exhaust tube 31 can be attached to the casing 3 by performing an easy operation to fit the upstream end portion 31U of the exhaust tube 31 to the cylindrical projection 34, and therefore it is possible to make the production time required to produce the outboard motor 1 even shorter. This makes it possible to reduce the production costs of the outboard motor 1.

Additionally, in the present preferred embodiment, the downstream portion of the idle exhaust passage 30 includes the inner peripheral surface of the exhaust tube 31. The exhaust tube 31 includes the drainage port 42 opened at the inner peripheral surface of the exhaust tube 31. The drainage port 42 extends downwardly from the lower end portion of the inner peripheral surface of the exhaust tube 31, and the idle exhaust passage 30 is in communication with the outside of the exhaust tube 31 through the drainage port 42. Therefore, water in the exhaust tube 31 is discharged outwardly from the exhaust tube 31 through the drainage port 42. As a result, the volume of water in the exhaust tube 31 is reduced, and the contamination of the inside of the exhaust tube 31 is prevented.

Additionally, in the present preferred embodiment, the exhaust tube 31 is made of an elastic material, such as rubber or resin, and therefore the exhaust tube 31 is easily bent. Therefore, the exhaust tube 31 can reliably follow or move with the displacement of the casing 3 and that of the engine cover 13. This makes it possible to reduce the amount of positional deviation of the exhaust tube 31 and to prevent the detachment of the exhaust tube 31 from the casing 3 and from the engine cover 13. Additionally, the exhaust tube 31 is a single cylindrical member, and therefore the number of components of the exhaust tube 31 can be minimized. This makes it possible to reduce the number of components of the outboard motor 1.

Although preferred embodiments of the present invention have been described as above, the present invention is not limited to the contents of the aforementioned preferred embodiments, and can be variously modified within the scope of the appended claims.

For example, as described in the above preferred embodiments, the number of exhaust tubes 31 mounted in the outboard motor 1 preferably is one, for example. However, the outboard motor 1 may include a plurality of exhaust tubes 31 and a plurality of cylindrical projections 34 corresponding to these tubes.

Additionally, as described in the above preferred embodiments, the downstream end portion 31D of the exhaust tube 31 is preferably supported by the engine cover 13 such that it does not contact the apron 14, for example. However, the downstream end portion 31D of the exhaust tube 31 may be supported by the apron 14 such that it does not contact the engine cover 13, or may be supported by both the engine cover 13 and the apron 14. Additionally, the exhaust tube 31 may be in non-contact with both the engine cover 13 and the apron 14, and be supported by the casing 3 in a cantilevered manner.

Additionally, as described in the above preferred embodiments, the exhaust tube 31 preferably includes the pedestal portion 37, the mounting projection 38, the annular projections 39, the thick-walled portion 40, and the liquid guide 41 in addition to the cylindrical portion 36, for example. However, it is permissible that the exhaust tube 31 does not include at least one of the pedestal portion 37, the mounting projection 38, the annular projection 39, the thick-walled portion 40, and the liquid guide 41. Likewise, it is permissible that the exhaust tube 31 does not include the drainage port 42 through which water in the exhaust tube 31 is discharged.

Additionally, as described in the above preferred embodiments, the cylindrical portion 36, the pedestal portion 37, the mounting projection 38, the annular projections 39, the thick-walled portion 40, and the liquid guide 41, which are constituents of the exhaust tube 31, preferably are integrally formed, for example. However, if a portion (i.e., cylindrical portion 36) that defines the downstream portion of the idle exhaust passage 30 is integrally formed, the other portions (pedestal portion 37, mounting projection 38, annular projection 39, thick-walled portion 40, and liquid guide 41) of the exhaust tube 31 may be members that differ from the cylindrical portion 36 and that are joined to the cylindrical portion 36.

The present application corresponds to Japanese Patent Application No. 2012-230015 filed on Oct. 17, 2012 in the Japan Patent Office, the entire disclosure of which is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine;

an exhaust passage member disposed below the engine, the exhaust passage member defining a main exhaust passage arranged to guide exhaust gases of the engine to a main exhaust port disposed in water, the exhaust passage member also defining a portion of an idle exhaust passage, the idle exhaust passage diverging from the main exhaust passage and arranged to guide exhaust gases in the main exhaust passage to an idle exhaust port opened to outside;

an idle exhaust passage member including an upstream end connected to the exhaust passage member and a downstream end that defines the idle exhaust port and is disposed at a higher position than the upstream end, the idle exhaust passage member defining a downstream portion of the idle exhaust passage, the downstream portion connecting the portion of the idle exhaust passage defined by the exhaust passage member to the idle exhaust port, the idle exhaust passage member being integrally formed from the upstream end to the downstream end; and an upstream-side mounting structure that includes a cylindrical projection provided on the exhaust passage member, the cylindrical projection including an inner peripheral surface defining a portion of the idle exhaust passage, wherein an upstream end portion of the idle exhaust passage member is attached to the exhaust passage member by the upstream end portion of the idle exhaust passage member being attached to the cylindrical projection.

2. The outboard motor according to claim 1, further comprising an engine cover with which the engine is covered, wherein a downstream end portion of the idle exhaust passage member is supported by the engine cover.

3. The outboard motor according to claim 2, wherein the downstream end of the idle exhaust passage member is disposed at a more rearward position than a lower end portion of the engine cover such that the idle exhaust port is located at a more rearward position than an outer surface of the outboard motor below the idle exhaust port.

4. The outboard motor according to claim 2, wherein the downstream end portion of the idle exhaust passage member is disposed below the engine cover and along a lower surface of the engine cover.

5. The outboard motor according to claim 1, wherein the idle exhaust passage member is a cylindrical member made of rubber or resin.

6. An outboard motor comprising:

an engine;

an exhaust passage member disposed below the engine, the exhaust passage member defining a main exhaust passage arranged to guide exhaust gases of the engine to a main exhaust port disposed in water, the exhaust passage member also defining a portion of an idle exhaust passage, the idle exhaust passage diverging from the main exhaust passage and arranged to guide exhaust gases in the main exhaust passage to an idle exhaust port opened to outside;

an idle exhaust passage member including an upstream end connected to the exhaust passage member and a downstream end that defines the idle exhaust port and is disposed at a higher position than the upstream end, the idle exhaust passage member defining a downstream portion of the idle exhaust passage, the downstream portion connecting the portion of the idle exhaust passage defined by the exhaust passage member to the idle exhaust port, the idle exhaust passage member being integrally formed from the upstream end to the downstream end;

an engine cover with which the engine is covered, a downstream end portion of the idle exhaust passage member being supported by the engine cover; and an apron with which the exhaust passage member is covered, wherein the downstream end portion of the idle exhaust passage member protrudes rearwardly from the apron through a space between the engine cover and the apron, and is supported by the lower end portion of the engine cover such that the downstream end portion of the idle exhaust passage does not contact the apron.

7. The outboard motor according to claim 6, wherein the idle exhaust passage member further includes a liquid guide disposed below the idle exhaust port, the liquid guide being disposed at a more rearward position than an outer surface of the apron, the liquid guide tapering toward a lower end of the liquid guide.

8. An outboard motor comprising:

an engine;

an exhaust passage member disposed below the engine, the exhaust passage member defining a main exhaust passage arranged to guide exhaust gases of the engine to a main exhaust port disposed in water, the exhaust passage member also defining a portion of an idle exhaust passage, the idle exhaust passage diverging from the main exhaust passage and arranged to guide exhaust gases in the main exhaust passage to an idle exhaust port opened to outside;

an idle exhaust passage member including an upstream end connected to the exhaust passage member and a downstream end that defines the idle exhaust port and is disposed at a higher position than the upstream end, the idle exhaust passage member defining a downstream portion of the idle exhaust passage, the downstream portion connecting the portion of the idle exhaust passage defined by the exhaust passage member to the idle exhaust port, the idle exhaust passage member being integrally formed from the upstream end to the downstream end;

an engine cover with which the engine is covered, wherein a downstream end portion of the idle exhaust passage member is supported by the engine cover; and a downstream-side mounting structure that includes a mounting hole extending upwardly from a lower surface of the engine cover and a mounting projection extending upwardly from the downstream end portion of the idle exhaust passage member, wherein the downstream end portion of the idle exhaust passage member is attached to the engine cover by inserting the mounting projection into the mounting hole.

9. An outboard motor comprising:

an engine;

an exhaust passage member disposed below the engine, the exhaust passage member defining a main exhaust passage arranged to guide exhaust gases of the engine to a main exhaust port disposed in water, the exhaust passage member also defining a portion of an idle exhaust passage, the idle exhaust passage diverging from the main exhaust passage and arranged to guide exhaust gases in the main exhaust passage to an idle exhaust port opened to outside; and an idle exhaust passage member including an upstream end connected to the exhaust passage member and a downstream end that defines the idle exhaust port and is disposed at a higher position than the upstream end, the idle exhaust passage member defining a downstream portion of the idle exhaust passage, the downstream portion connecting the portion of the idle exhaust passage defined by the exhaust passage member to the idle exhaust port, the idle exhaust passage member being integrally formed from the upstream end to the downstream end; wherein the idle exhaust passage member includes an inner peripheral surface that defines the downstream portion of the idle exhaust passage, and the idle exhaust passage member includes a drainage port extending downwardly from a lower end portion of the inner peripheral surface of the idle exhaust passage member and communicating the idle exhaust passage with an outside of the idle exhaust passage member.

* * * * *